United States Patent [19]

Revane

[11] 4,308,688

[45] Jan. 5, 1982

[54] TREE WELL COVER

[76] Inventor: Thomas L. Revane, 10469 Corvallis Ct., Ventura, Calif. 93003

[21] Appl. No.: 126,459

[22] Filed: Mar. 3, 1980

[51] Int. Cl.[3] ..... A01G 17/00
[52] U.S. Cl. ..... 47/25; 47/32
[58] Field of Search ..... 47/25, 32, 33, 9

[56] References Cited

U.S. PATENT DOCUMENTS

| | | | |
|---|---|---|---|
| 80,012 | 7/1868 | Robbins | 47/32 |
| 173,446 | 2/1876 | Cottman | 47/25 |
| 2,822,644 | 2/1958 | Berger | 47/32 |
| 3,305,969 | 2/1967 | Mattson | 47/25 |
| 3,396,488 | 8/1968 | Ries | 47/33 |

FOREIGN PATENT DOCUMENTS

| | | | |
|---|---|---|---|
| 271715 | 4/1913 | Fed. Rep. of Germany | 47/25 |
| 2518441 | 11/1976 | Fed. Rep. of Germany | 47/32 |
| 496987 | 3/1976 | U.S.S.R. | 47/32 |

*Primary Examiner*—Robert E. Bagwill
*Attorney, Agent, or Firm*—Kenneth J. Hovet

[57] ABSTRACT

Two or more fiberglass preformed sections interfit to form a cover about the base of a tree. The sections are provided with a series of underlying rings spaced apart concentrically radially outward from a central opening through which the tree extends. The rings provide reinforcement to each section and function as guides for subsequent cutting of larger holes as the tree grows. When concrete or the like is to be poured about the tree, a framework is used as a concrete form to insure the cover sections fit together properly.

12 Claims, 9 Drawing Figures

TREE WELL COVER

BACKGROUND OF THE INVENTION

1. Field of the Invention

The present invention relates to protective ground covers for the region surrounding upright elements and, more particularly, to a permanent tree well cover having an opening which can be enlarged in-situ.

2. Description of the Prior Art

As depicted in FIG. 1, the typical prior art cover which has been installed about the base of a tree is constructed of concrete, asphalt or in some cases cast iron. Covers constructed of these materials suffer greatly from the sheer weight thereof and the inherent difficulty in handling. After a period of time the covers typically become cracked as the foundation thereunder becomes eroded, overgrown, or for whatever other reason. This allows for unsightly weeds and plant growth to appear. Such structures also do not include any means for enlargement and must be broken-up with sledge hammers and the like and removed to provide for the growth of a tree.

German Pat. Nos. 2,517,949 and 2,317,216 have attempted to overcome the above problem by providing covers with segmented annular parts. The parts or segments can be removed to provide for the increase in diameter of a growing tree. However, since the removable parts are preformed, their versatility for expansion is greatly limited. Unfortunately, having preformed segments also makes the covers more susceptible to vandalism.

Additionally, since the patented structures utilize concrete and cast iron as materials of construction, they are costly to manufacture and cumbersome to handle. Still further, such materials of construction suffer the prior art disadvantages of being breakable or allowing cracks to form through which unsightly weeds can grow as shown in FIG. 1.

SUMMARY OF THE INVENTION

In accordance with the present invention, a tree well cover is provided which is light-weight in construction and can readily be severed by a saw or the like to allow for the growth of a tree or the use of various external elements such as lighting fixtures, drainage and support means.

The invention is constructed of reinforced plastic or fiberglass wherein two or more sections interfit and surround the base of a tree with a central opening. On the underside of each section are a plurality of downwardly extending rings which are radially offset from each other. Each of the rings provide reinforcement for each section and further, when located in a predetermined manner, provide for a convenient guide means for the subsequent removal of portions of each section. In this way the central opening can be enlarged in-situ without the disadvantages of the prior art.

Each section is further provided with a peripheral downwardly extending wall comprising an outer portion which defines the configuration of the cover and matching inner face portions which operate to abut against corresponding face portions of other sections. With the above construction, each individual section is self-supporting and can be any of the hereinafter described configurations as dictated by environmental, manufacturing and asthetic needs.

Adjacent the outer peripheral wall portion is an optional preformed framework having the same configuration as the overall cover. The framework is utilized as a concrete form and facilitates the proper alignment of the sections positioned therein.

DESCRIPTION OF THE PREFERRED EMBODIMENTS

Figure 6:
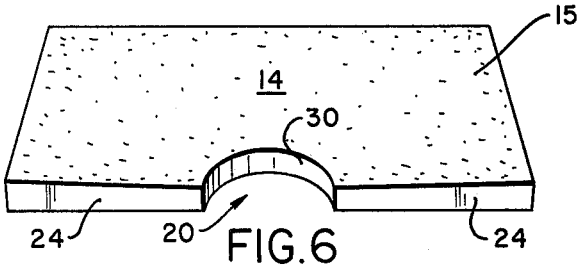
FIG. 6 is perspective view showing the top side of one section of the cover of the present invention.

Referring now to the drawings and, more particularly, to FIGS. 3, 6 and 7 thereof, the tree well cover 10 of the present invention will be described. In the embodiment shown, the cover comprises two sections 12 and 14. Each section is a mirror image of the other section. The sections shown are generally rectangular in overall shape with a semi-circular cutout 20, 22 located about midpoint along the inwardly-facing wall portions 24, 26 of each respective section.

It will be understood, however, that more than two sections may be utilized with the present invention and that said sections may be of any convenient geometrical configuration to form the desired cover. For example, the overall shape of the cover may be round, oblong or oval shaped and there may be three or more individual sections having a wedge-like shape which interfit to form the complete cover. Similarly, the overall configuration may be triangular, quadrilateral or polygonal. For example, when the assembled cover resembles a triangle, the individual sections would have a triangular or rhombic-like shape.

Figure 3:
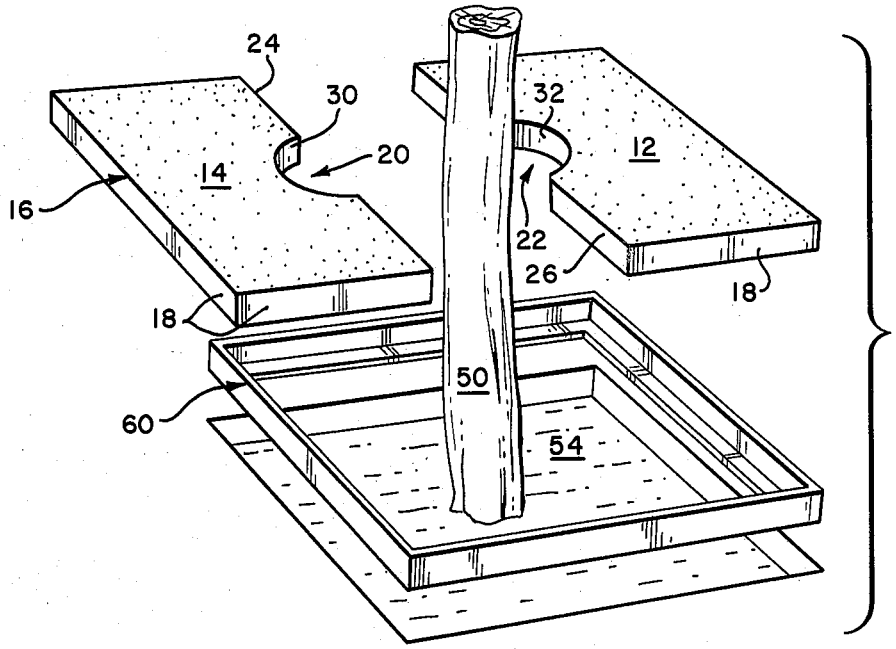
FIG. 3 is an exploded perspective view of the invention shown in FIG. 2.
Figure 4:
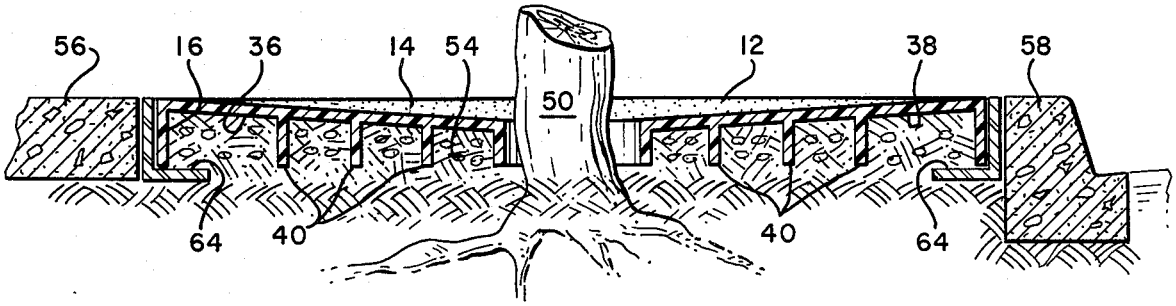
FIG. 4 is a cross-sectional view taken along lines 4—4 of FIG. 2.
Figure 5:
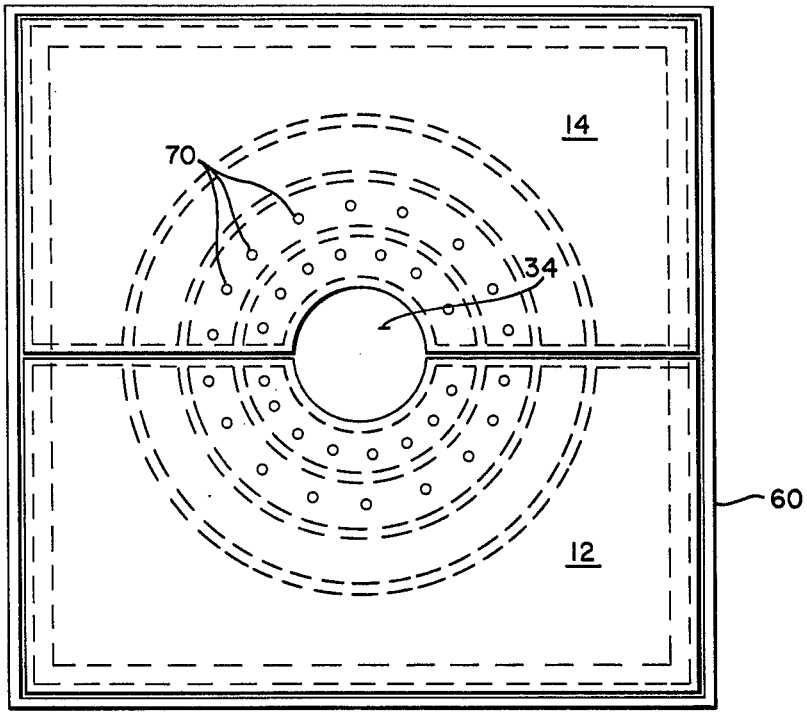
FIG. 5 is a top plan view of the invention shown in FIG. 2.

In any case, the sections should include an outer peripheral wall structure, shown generally in FIGS. 3 and 4 by reference numeral 16. The peripheral wall comprises one or more outer portions 18 and the aforesaid face portions 24, 26 adapted for abutment with each other and/or corresponding face portions of other sections. The wall may be continuous throughout as shown or it may comprise a series of spaced-apart legs to conserve on materials of construction (not shown).

As shown in FIG. 3, the semi-circular cutouts 20,22 form a central circular opening 34 when the sections 12 and 14 are placed adjacent each other. In this case the matching inner facing surfaces 24, 26 abut against each other and the opening 34 is defined by inner rings 30,32.

Depending from the underside 36,38 of each section, are downwardly extending semi-circular rings shown by reference numeral 40. The rings are spaced successively radially outwardly from the innermost rings 30,32.

In the preferred embodiment, each of said rings are arranged concentric with the inner rings and extend downwardly a distance successively less than the height of outer wall portions 18 to a minimum height represented by the inner rings. In this manner each section will have a tendency to be properly supported by ground-fill materials when interfitted about the base 50 of a tree.

As described hereinabove, the sections are constructed of severable fiberglass or reinforced plastic materials well known in the art. As such, correspondingly larger diameter central openings 34 may readily be created simply by cutting along the inwardly facing surface of a predetermined underside ring 40.

Figure 7:
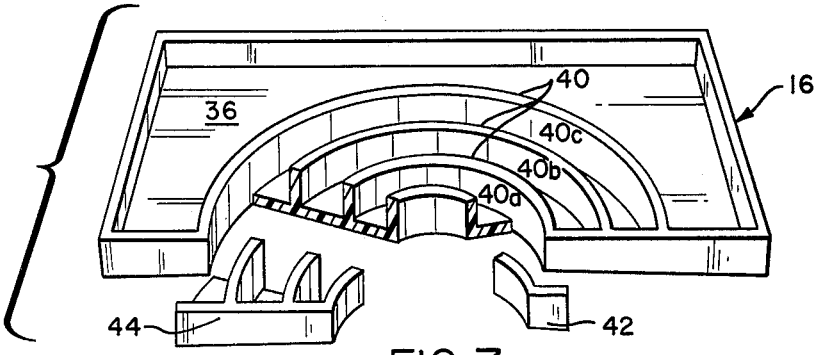
FIG. 7 is an exploded perspective view of the underside of the section shown in FIG. 6 depicting portions thereof which can be removed.

As best shown in FIG. 7, cutting along the inside surface of ring 40*a* of each section results in the removal of a small semicircular portion, partially depicted by fragment 42, and creates a slightly enlarged circular opening. Creation of the largest possible opening is accomplished by cutting along the inner surface of ring 40*c* and removal of all the prior succeeding inner flanges, a fragment of which is shown by reference numeral 44.

The particular ring to be cut along will be dictated by the size and type of tree base to be encompassed—taking into consideration other environmental conditions and necessities. For example, space should be provided for irrigation and/or mulching implements, if desired, and room should be provided for any support means which may be needed in the case of young and/or small caliper trees located in windy areas. In these cases, partial cut-outs may be made such as, for example, from only one section or from a part of one section or different parts of two or more sections. In this regard, it is clear that opening 34 can have a wide variety of configurations other than circular. Likewise, inner rings 30,32 and rings 40 can have configurations other than semicircular and each can be different from the other. Of course, as the tree grows successively larger, cutouts along rings 40 are made to accommodate the increasing diameter of the tree trunk.

Preferably, the area to be covered by the tree well cover of the present invention is overlaid with a granular ground-fill material 54 such as sand, rocks, gravel or other material, taken alone or in combination, which permits the flow of air and water thereabout. Use of such material further permits penetration therein of the annular rings 40 and peripheral wall structure 16 thereby providing a solid stable placement of the cover sections.

Figure 1:
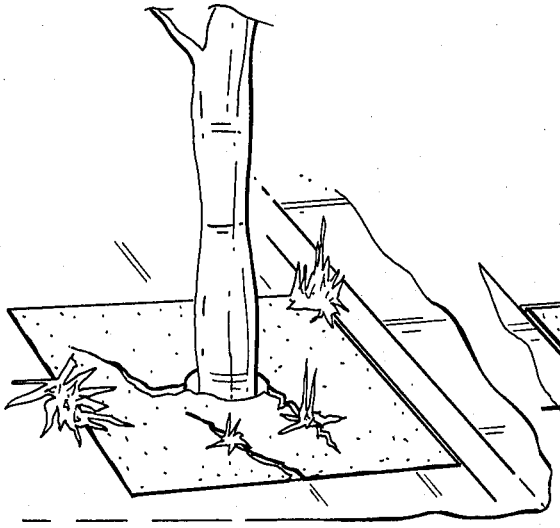
Prior Art FIG. 1
FIG. 1 is a perspective view depicting the prior art and some of the problems inherent therewith.
Figure 2:
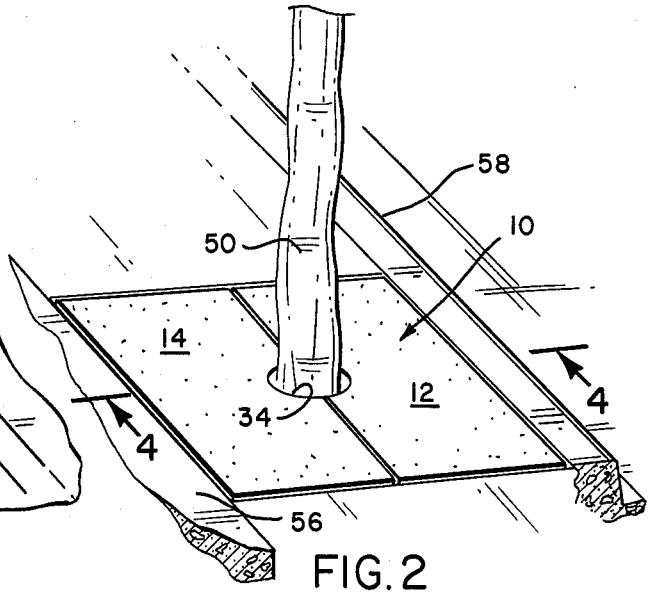
FIG. 2 is a perspective view showing the present invention installed within an optional framework along a sidewalk adjacent a curb.

When the cover is located within an opening surrounded by concrete, such as that envisioned in FIG. 2 with sidewalk 56 or curbing 58, the cover may be secured and properly sealed with a resilient sealing material placed about the periphery of the cover and along the abutment of wall portions 24,26. Examples of such are mastic, polyurethane resins, latex caulking compounds and the like.

In many cases, use of the present invention will be contemplated prior to the formation of a sidewalk, patio, curbing or the like. In such cases the present invention comprehends the use of an optional premolded outer framework 60, preferably constructed of fiberglass or plastic.

Figure 9:
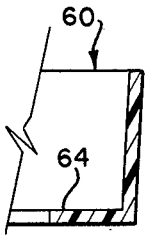
FIG. 9 is an enlarged fragmentary cross-sectional view taken along lines 9—9 of FIG. 8.
Figure 8:
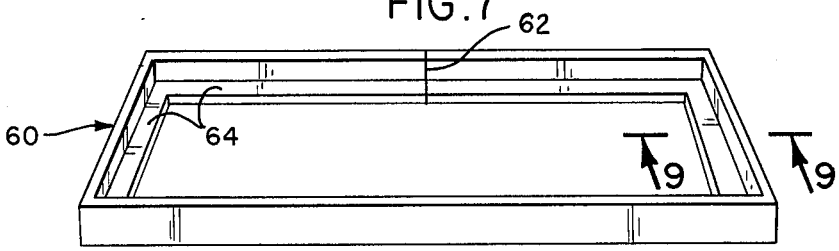
FIG. 8 is a perspective view of the optional framework shown in FIGS. 2–5.

As best shown in FIGS. 8 and 9, the framework is L-shaped in cross-section and has the same geometrical configuration as that defined by the periphery of the assembled tree well cover. Such framework is typically provided with at least one point of severance such as that shown by reference numeral 62.

By virtue of the inherent resilience of the material of construction thereof, the frame may be twisted to separate the severed ends. With such a manipulation, the distance of separation of the ends can be made large enough to permit passing of the tree trunk and allow one to position the frame on the surrounding ground in a manner to completely encircle the tree. In this manner the frame will act as a form about which concrete may be poured and which will therein provide a method of creating a properly dimensioned opening into which is placed the sections of the tree well cover without fear of uneven or non-square corners causing a misaligned, skewed or canted placement.

As best shown in FIG. 4, the frame becomes a permanent part of the surrounding concrete structure. The frame provides a further advantage wherein the frame foot portion 64 operates as a level solid support for the peripheral wall 16 of each section.

Additional features of the present invention include the provision of optional drainage holes 70 extending through the thickness of the cover. In this regard it will be noted that the topside of each section is slanted downwardly from the outer periphery of the cover toward the central opening 34. In this manner, rain water will be directed toward the base of the tree carrying moisture enrichment to the tree roots.

It will be understood that for purposes of the present invention, the term "tree" as used herein, is to include inert upright elements such as street signs, poles, rods and the like and other forms of plant life besides a tree per se such as, for example, shrubs or flowers or any combination thereof.

A particular advantage of the present invention resides in its fiberglass or reinforced plastic construction which allows for ease of forming, handling, cutting and subsequent lightweight use. Additionally, during the cover molding process, the top surface may readily be provided with any one or more embedded pebbles, gravel, rocks, coloring or texturized finishes dictated by the contemplated end use and environment in which the cover is to be used. Also, as a result of the plastic or fiberglass construction, it is easy to provide for the installation of electrical fixtures, and the like in-situ, which heretofore were difficult and expensive to install in the prior art concrete and cast iron structures.

While the invention has been described with respect to preferred embodiments, it will be apparent to those skilled in the art that other modifications and improvements may be made without departing from the spirit and scope of the invention. Accordingly, it is to be understood that the invention is not to be limited by the specific illustrative embodiments, but only by the scope of the appended claims.

I claim:

1. A tree well cover having at least two sections which interfit and form a central opening which encompasses the base of a tree wherein each section includes a top side and an underside, said underside including a plurality of downwardly depending ring members radially offset from each other and a peripheral downwardly extending wall, said wall including an outer portion and a face portion abutting a corresponding face portion of at least one other section.

2. The cover of claim 1 wherein the ring members include an inner ring that defines a portion of the central opening and said members are spaced apart concentrically to said inner ring.

3. The cover of claim 2 wherein the top side inclines toward said inner ring and the height of each ring member increases successively from the inner ring to an outermost ring.

4. The cover of claim 3 wherein the height of said outermost ring is no greater than the height of said peripheral wall.

5. The cover of claim 1 wherein said sections are mirror images of each other.

6. The cover of claim 5 wherein there are two quadrilateral sections each of which includes a cut-out area located about midpoint along the face portion thereof to form said central opening.

7. The cover of claim 1 including a preformed framework closely surrounding the peripheral wall of said cover and within which each of said sections interfit.

8. The cover of claim 7 wherein said framework is L-shaped in cross-section and has a height greater than the height of said peripheral wall.

9. The cover of claim 8 wherein said framework is severed through its cross-section at least at one location thereof.

10. The cover of claim 9 wherein said framework includes an inwardly directed foot portion for supporting said peripheral wall.

11. The cover of claim 1 wherein the top side includes any one or a combination of embedded pebbles, rocks, or sand, coloring or texturizing materials.

12. The cover of claim 1 including drainage holes extending therethrough.

* * * * *